US012371631B2

(12) United States Patent
Saccomando et al.

(10) Patent No.: US 12,371,631 B2
(45) Date of Patent: Jul. 29, 2025

(54) BASIC ASHLESS ADDITIVES AND LUBRICATING COMPOSITIONS CONTAINING SAME

(71) Applicant: The Lubrizol Corporation, Wickliffe, OH (US)

(72) Inventors: Daniel J. Saccomando, Belper (GB); Yanshi Zhang, Solon, OH (US); John-Louis DiFlavio, Mentor, OH (US); Ewan E. Delbridge, Victoria (AU); William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/269,775

(22) PCT Filed: Jan. 6, 2022

(86) PCT No.: PCT/US2022/011423

§ 371 (c)(1),
(2) Date: Jun. 27, 2023

(87) PCT Pub. No.: WO2022/150464

PCT Pub. Date: Jul. 14, 2022

(65) Prior Publication Data

US 2024/0084211 A1 Mar. 14, 2024

Related U.S. Application Data

(60) Provisional application No. 63/134,346, filed on Jan. 6, 2021.

(51) Int. Cl.

| | |
|---|---|
| ***C10M 133/06*** | (2006.01) |
| ***C10M 169/04*** | (2006.01) |
| *C10N 20/00* | (2006.01) |
| *C10N 30/00* | (2006.01) |
| *C10N 30/10* | (2006.01) |
| *C10N 40/25* | (2006.01) |

(52) U.S. Cl.

CPC ..... *C10M 133/06* (2013.01); *C10M 169/04* (2013.01); *C10M 2201/043* (2013.01); *C10M 2207/04* (2013.01); *C10M 2215/04* (2013.01); *C10M 2219/046* (2013.01); *C10N 2020/01* (2020.05); *C10N 2020/067* (2020.05); *C10N 2030/10* (2013.01); *C10N 2030/36* (2020.05); *C10N 2030/42* (2020.05); *C10N 2030/43* (2020.05); *C10N 2030/45* (2020.05); *C10N 2030/52* (2020.05); *C10N 2040/25* (2013.01)

(58) Field of Classification Search

CPC ..... C10M 133/06; C10M 169/04; C10M 2215/04; C10M 2219/046; C10M 133/12; C10N 2020/01; C10N 2030/10; C10N 2030/36; C10N 2030/42; C10N 2030/43; C10N 2030/45; C10N 2030/52; C10N 2040/25

USPC ..... 508/545, 563

See application file for complete search history.

(56) References Cited

U.S. PATENT DOCUMENTS

| | | | |
|---|---|---|---|
| 3,172,892 | A | 3/1965 | Le Suer et al. |
| 3,372,116 | A | 3/1968 | Meinhardt |
| 3,381,022 | A | 4/1968 | Le Suer |
| 3,471,404 | A | 10/1969 | Myers |
| 3,634,515 | A | 1/1972 | Piasek et al. |
| 4,191,659 | A | 3/1980 | Davis |
| 4,234,435 | A | 11/1980 | Meinhardt et al. |
| 4,285,822 | A | 8/1981 | Devries et al. |
| 4,654,403 | A | 3/1987 | Tipton |
| 4,719,023 | A | 1/1988 | Macphail et al. |
| 5,157,088 | A | 10/1992 | Dishong et al. |
| 5,256,752 | A | 10/1993 | Dishong et al. |
| 5,395,539 | A | 3/1995 | Chandler et al. |
| 6,200,936 | B1 | 3/2001 | Moreton |
| 6,310,009 | B1 | 10/2001 | Kocsis et al. |
| 6,310,011 | B1 | 10/2001 | Karn et al. |
| 6,569,818 | B2 | 5/2003 | Nakazato et al. |
| 7,407,919 | B2 | 8/2008 | Wilk et al. |
| 7,651,987 | B2 | 1/2010 | Kocsis. et al. |

(Continued)

FOREIGN PATENT DOCUMENTS

| | | |
|---|---|---|
| EP | 0355895 | 1/1991 |
| EP | 2039746 | 3/2009 |

(Continued)

OTHER PUBLICATIONS

Deblina Roy et al., "Benzhydryl Amines: Synthesis and Their Biological Perspective", ACS Omega, vol. 5, No. 1, Jan. 14, 2020, pp. 19-30.

(Continued)

*Primary Examiner* — Ellen M Mcavoy

(74) *Attorney, Agent, or Firm* — Eryn A. Fuhrer; Michael A. Miller

(57) ABSTRACT

The disclosed technology relates to a lubricating composition comprising an oil of lubricating viscosity and an ashless basic amine additive selected from a secondary amine containing α-carbon aromatic substitution. The basic secondary amine additives used in the lubricating oils of the disclosed technology impart basicity measured as total base number (TBN) without adding sulfated ash. Lubricating oils containing the basic secondary amine additives of the disclosed technology simultaneously achieve seals compatibility, deposit, and corrosion control.

29 Claims, No Drawings

(56) References Cited

U.S. PATENT DOCUMENTS

| | | | | |
|---|---|---|---|---|
| 7,727,943 | B2 | 6/2010 | Brown et al. | |
| 7,772,171 | B2 | 8/2010 | Al-Ahmad et al. | |
| 9,441,180 | B2 | 9/2016 | Preston et al. | |
| 9,783,756 | B2 | 10/2017 | Saccomando et al. | |
| 2007/0082828 | A1* | 4/2007 | Nalesnik | C10M 133/12 564/305 |
| 2008/0058235 | A1 | 3/2008 | Takigawa et al. | |
| 2009/0131293 | A1* | 5/2009 | Ma | C10M 133/12 564/428 |
| 2019/0330554 | A1* | 10/2019 | Jiang | C10M 129/06 |
| 2020/0407658 | A1* | 12/2020 | Rowland | C07C 217/92 |
| 2022/0259514 | A1* | 8/2022 | Saccomando | C10M 133/16 |

FOREIGN PATENT DOCUMENTS

| | | |
|---|---|---|
| EP | 2206764 | 7/2010 |
| WO | 0156968 | 8/2001 |
| WO | 2010077630 | 7/2010 |

OTHER PUBLICATIONS

Donald Bethell et al., "Intermediates in the Decomposition of Aliphatic Diozo-Compounds. Part XI. Mechanistic Studies on the Reaction of Diphenylmethylene with Amines in Solutions", Jan. 1, 1974; pp. 1307-1312.

* cited by examiner

BASIC ASHLESS ADDITIVES AND LUBRICATING COMPOSITIONS CONTAINING SAME

CROSS REFERENCE TO RELATED APPLICATION

This application claims priority from PCT Application Serial No. PCT/US2022/011423 filed on Jan. 6, 2022, which claims the benefit of U.S. Provisional Application No. 63/134,346 filed on Jan. 6, 2021, both of which are incorporated in their entirety by reference herein.

FIELD OF THE TECHNOLOGY

The disclosed technology relates to additives for lubricating oil compositions, lubricating oils containing the additives, and methods for lubricating an engine. The additives used in the lubricating oils of the disclosed technology impart basicity measured as total base number (TBN) without adding sulfated ash, phosphorus and sulfur. The additives mitigate crankcase corrosion and have improved compatibility with fluoroelastomeric seals.

BACKGROUND

Lubricating oil compositions used to lubricate internal combustion engines contain a major portion of a base oil of lubricating viscosity and a variety of lubricating oil additives to improve the performance of the oil. Lubricating oil additives are used to improve detergency, reduce engine wear, provide stability against heat and oxidation, inhibit corrosion and increase engine efficiencies by reducing friction. Internal combustion engines produce acidic and pro-oxidant by-products resulting from the incomplete combustion of hydrocarbon fuels. These by-products lead to deleterious effects in the engine oil, and likewise in the engine. The by-products may, for example, oxidize hydrocarbons found in the lubricating oil, yielding carboxylic acids and other oxygenates. These oxidized and acidic hydrocarbons cause engine corrosion, wear and deposit problems. Lubricants must be able to neutralize acidic materials produced by combustion.

Historically, base-containing additives have been added to lubricants to neutralize such by-products, thus reducing the harm they cause to the lubricant and to the engine. Overbased hydrocarbon sulfonic acid detergents with metal bases such as calcium or magnesium oxide or carbonate have been used for some time as acid scavengers, neutralizing acidic by-products and protecting both the lubricant and the engine. The neutralizing function of overbased detergents is particularly important for extended oil drain intervals, where reduced detergent levels may jeopardize oil life. However, overbased detergents carry with them an abundance of metal as measured by sulfated ash. As the lubricating oil containing the overbased detergent is consumed, the metal forms ashy deposits and residues. Overbased metal detergents in combination with anti-wear agents such as zinc dialkyldithiophosphate (ZDDP) add sulfated ash, phosphorus and sulfur (SAPS) by-products, which can interfere with engine particulate filters and emissions catalyst performance. New industry upgrades for diesel and passenger car lubricating oils are putting ever decreasing limits on the amount of SAPS, and by extension the amount of overbased detergent and/or anti-wear agent formulated into an oil. However, by minimizing the presence of overbased detergents and anti-wear agents there is a concomitant decrease in the basicity of the oil and the ability to neutralize acidic by-products formed during the combustion process, ultimately jeopardizing oil life and requiring shorter change intervals.

Oil life may be extended by increasing the total basicity of the oil, often expressed as total base number (TBN). However, the challenge is to deliver TBN without adding SAPS or highly basic compounds which induce corrosion. Certain TBN boosting compounds, such as amine compounds, have been used to help neutralize acids formed during combustion in the engine. However, certain of these amine compounds can have detrimental effects on elastomeric seals. Certain amines are believed to cause dehydrofluorination of the fluoropolymer backbone. The resulting unsaturation that forms is susceptible to oxidation, leading to a loss of physical properties, seals degradation and ultimate failure. Seals failure impairs engine performance, increases the potential for engine damage, and leads to environmentally unacceptable oil seepage from the crankcase.

Basic amine additives have nevertheless been investigated as alternatives to ash containing overbased metal detergents, for example, alkyl and aromatic amines. Basic amine additives, such as succinimide dispersants, contain polyamine groups which provide a source of basicity. However, as mentioned above, such amines are believed to cause dehydrofluorination in fluoroelastomeric seals materials. Generally, the base content or TBN of a lubricant can only be boosted modestly by amine dispersants before seals degradation and/or corrosion becomes a significant issue, limiting the amount of TBN that can be provided by such additives.

There are two common measures of basicity that are used in the field of lubricant additives. Total base number may be measured by ASTM D2896, which is a titration that measures both strong and weak bases. On the other hand, ASTM D4739 is a titration that measures strong bases. Amines that titrate ASTM D2896 are known to be more aggressive to fluoropolymer seals, while those that titrate D4739 are less aggressive. Accordingly, many lubricant applications require TBN as titrated by ASTM D4739.

Succinimide dispersants have a relatively high basic nitrogen content expressed as TBN (ASTM D2896). Generally, higher nitrogen content gives better dispersancy and deposit control. However, the task is to deliver high TBN as measured by ASTM D4739 without harming seals compatibility.

U.S. Pat. No. 9,441,180 discloses anthranilic ester compounds as additives in lubricants. This document discloses compositions that are said to deliver an ash-free base to a lubricant in the form of a basic amine additive, without adversely impacting seal compatibility. The examples report product TBN values of 150 to 188 as measured by D2896, which includes a titration of weak basicity.

U.S. Pat. No. 9,783,756 concerns N-monohydrocarbyl substituted γ-amino esters. While the disclosed γ-amino esters can titrate ASTM D4739, they are less persistent in the oil life cycle requiring shorter drain intervals.

It would be desirable to provide a lubricating oil composition with a high level of TBN using a TBN additive that does not contribute to SAPS. As highly basic additives are known to induce corrosion and reduce compatibility between lubricating oil compositions and the fluoroelastomeric seals used in engines, it would be advantageous to provide an additive that does not induce corrosion and does not adversely affect seals compatibility. Moreover, demands for improved fuel economy, less viscous lubricants such as 0 W and 5 W and 30 grade lubricants are becoming more desirable. To allow for easier formulation and reduced viscosities, desirably the amount of polymer introduced by additives should be minimized.

The additive of the disclosed technology solves the problem of providing strong basicity, as measured by ASTM D4739, to a lubricant, without imparting additional metal content in the form of SAPS and does not lead to the deterioration of fluoroelastomeric seals, as measured in accordance to the specification laid out in ("MB"—Mercedes Benz seals) DBL6674-FKM. This is accomplished by providing a non-polymeric N-aralkyl α-carbonyl functional amine additive as more fully described herein. As otherwise expressed, the technology provides the ability to impart relatively high TBN levels to a lubricant while maintaining the low SAPS levels specified by increasingly stringent governmental regulations, while at the same time protecting seals performance and compatibility as well as mitigating corrosion of metallic engine components.

SUMMARY OF THE DISCLOSED TECHNOLOGY

In one aspect, the present technology concerns a lubricating oil composition for internal combustion engines containing one or more basic ashless additive(s) for increasing the TBN of the composition without introducing SAPS.

In a related aspect, the present technology concerns a lubricating oil composition for internal combustion engines containing a major amount of an oil of lubricating viscosity and an effective amount of one or more basic ashless amine additive(s) suitable for increasing the TBN of the composition without introducing SAPS and which is compatible with fluoroelastomeric seals.

In a related aspect, the present technology concerns a lubricating oil composition for internal combustion engines containing a major amount of an oil of lubricating viscosity and an effective amount of one or more basic ashless amine additive(s) suitable for increasing the TBN of the composition without introducing SAPS, is compatible with fluoroelastomeric seals and mitigates corrosion of internal engine components.

In a related aspect, the present technology provides a method for preparing a high TBN lubricating oil composition with a reduced SAPS content for internal combustion engines comprising including one or more basic ashless additives selected from secondary amines containing α-carbon aromatic substitution which have been found to be useful as additives for increasing TBN of the lubricating oil composition without introducing SAPS.

In a related aspect, the present technology provides a use for one or more secondary amines containing α-carbon aromatic substitution as an ashless lubricating oil composition TBN source.

In a related aspect, the present technology provides a lubricating oil composition comprising one or more basic ashless additives selected from a secondary amine containing α-carbon aromatic substitution which composition meets the increasingly stringent standards for engine lubricant seals compatibility test performance specifications of ASTM, DIN, ISO, CEC and other local and commercial OEM standards.

In a related aspect, the present technology provides a method for improving the wear life and other tribological properties of an internal combustion engine by adding an effective amount of one or more secondary amines containing α-carbon aromatic substitution to a lubricating oil composition and circulating said additized oil of lubricating viscosity through an internal combustion engine under normal engine operating conditions.

In a related aspect, the present technology provides an additized lubricating oil composition suitable for reducing engine deposits and corrosion while increasing TBN and preventing or mitigating the degradation of elastomer seals in an internal combustion engine, said composition comprising:

a) an oil of lubricating viscosity and
b) one or more secondary amines containing α-carbon aromatic substitution.

In one aspect, the disclosed technology relates to a method of boosting TBN as measured by ASTM D4739. The method includes the step of adding to an oil of lubricating viscosity an ashless amine additive selected from a secondary amine containing α-carbon aromatic substitution.

In another related aspect, the present technology is directed to the use of one or more secondary amines containing α-carbon aromatic substitution to increase TBN, reduce SAPS, mitigate corrosion and improve the seals compatibility of a lubricating oil in an internal combustion engine.

DETAILED DISCLOSURE

Aspects according to the present technology are described hereinafter. Various modifications, adaptations or variations of such exemplary aspects described herein may become apparent to those skilled in the art as such are disclosed. It will be understood that all such modifications, adaptations or variations that rely on the teachings of the present technology, and through which these teachings have been advanced in the art, are considered to be within the scope and spirit of the disclosed technology.

The disclosed technology provides a lubricating oil composition comprising:

a) an oil of lubricating viscosity; and
b) an additive selected from one or more secondary amine(s) containing α-carbon aromatic substitution, said additive being present in an effective amount to increase TBN, reduce SAPS, mitigate corrosion and seals compatibility in an internal combustion engine.

The secondary amine additive of the disclosed technology will typically be presented in a lubricant or lubricant formulation, one component of which is an oil of lubricating viscosity. The oil of lubricating viscosity, also referred to as a base oil, may be selected from any of the base oils in Groups I-V of the American Petroleum Institute (API) Base Oil Interchangeability Guidelines.

Oil of Lubricating Viscosity

The oils of lubricating viscosity of can include, for example, natural and synthetic oils, oil derived from hydrocracking, hydrogenation, and hydrofinishing, unrefined, refined and re-refined oils and mixtures thereof. Oils of lubricating viscosity may also be defined as specified in the American Petroleum Institute (API) Base Oil Interchangeability Guidelines.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils and are obtained by processes similar to those used to obtain refined oils and often are additionally processed by techniques directed to removal of spent additives and oil breakdown products. Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof. Synthetic lubricating oils are useful and include hydrocarbon oils such as polymerised and interpolymerised olefins (e.g., polybutylenes, poly-propylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof. Other synthetic lubricating oils include polyol esters (such as Priolube® 3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one aspect, oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content>0.03 wt. %, and/or <90 wt. % saturates, viscosity index 80-120); Group II (sulphur content≤0.03 wt. %, and ≥90 wt. % saturates, viscosity index 80-120); Group III (sulphur content≤0.03 wt. %, and 0.90 wt. % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively, the oil of lubricating viscosity is often an API Group II, Group III or Group IV oil or mixtures thereof. In some aspects, the oil of lubricating viscosity used in the described lubricant compositions includes a Group III base oil.

The lubricating oil compositions of the disclosed technology comprise a major amount of oil of lubricating viscosity and a minor amount of one or more N-aralkyl α-carbonyl functional amine(s). The amount of the oil of lubricating viscosity present is typically the balance remaining after subtracting from 100 wt. % the sum of the amount of the additive(s), including the one or more N-aralkyl α-carbonyl functional amine(s) as described hereinbelow.

Basic Ashless Additive

A primary additive contained in the lubricating oil compositions of the disclosed technology is a basic ashless additive selected from a secondary amine containing α-carbon aromatic substitution. By α-carbon aromatic substitution is meant that at least one of the two α-carbon atoms immediately situated adjacent to the amine nitrogen contains at least one aromatic substituent.

Here and throughout the specification the term "aromatic" refers to an unsaturated aromatic carbocyclic group having a single ring (e.g., phenyl) or multiple condensed rings (e.g., naphthyl, anthryl, and phenanthryl). In one aspect, the aromatic group is homocyclic (no heteroatoms) containing from 6 to 14 annular carbon atoms. The term "aromatic" includes substituted and unsubstituted aromatic compounds. Exemplary substituents include, but are not limited to, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

Aromatic is inclusive of "heteroaromatic" which refers to an unsaturated aromatic carbocyclic group having from 2 to 10 annular carbon atoms and at least one annular heteroatom, including but not limited to heteroatoms selected from nitrogen, oxygen and sulfur. A heteroaromatic group may have a single ring (e.g., pyridyl, furyl) or multiple condensed rings (e.g., indolizinyl, benzothienyl) which condensed rings may or may not be aromatic.

In one aspect, the aromatic substituent is a phenyl group which can be substituted or unsubstituted. In one aspect, the phenyl substituent(s) is independently substituted with $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

Here and throughout the specification the term "hydrocarbyl" is used in its ordinary sense, which is well-known to those skilled in the art. Specifically, it refers to a group having a carbon atom directly bonded to at least one of the two α-carbon atoms adjacent to the amine nitrogen. In one aspect, hydrocarbyl includes a moiety containing 1 to 24 carbon atoms, or 2 to 16 carbon atoms, or 3 to 12 carbon atoms, or 4 to 8 carbon atoms. The hydrocarbyl group can be substituted or unsubstituted. Substituents include alkyl, alkenyl, amino, hydroxyl, alkoxy, and halo groups. In one aspect, the hydrocarbyl group is $C_1$ to $C_{24}$ alkyl.

The term "alkyl" refers to and includes saturated linear and branched, hydrocarbon structures and combinations thereof. Alkyl groups are those having 1 to 24, or 2 to 16, or 3 to 12, or 4 to 8 carbon atoms. When an alkyl radical having a specific number of carbons is named, all geometric isomers having that number of carbons are intended to be encompassed and described, for example, "propyl" includes n-propyl and isopropyl, and "butyl" includes n-butyl, sec-butyl, iso-butyl and tert-butyl. This term is exemplified by groups such as methyl, ethyl, propyl, isopropyl, n-butyl, sec-butyl, iso-butyl, pentyl, neo-pentyl, hexyl, heptyl octyl, and the like.

The term "alkenyl" refers to an unsaturated hydrocarbon group having at least one site of olefinic unsaturation (i.e., having at least one carbon-carbon double bond). In one aspect, the alkenyl group contains from 2 to 24, or 2 to 16, or 3 to 12, or 4 to 8 carbon atoms. Examples of alkenyl groups include but are not limited to ethenyl, propenyl, octenyl, nonenyl and oleoyl.

The term "alkynyl" refers to an unsaturated hydrocarbon group having at least one site of acetylenic unsaturation (i.e., having at least one carbon-carbon triple bond). In one aspect the alkynyl group contains from 2 to 24, or 2 to 16, or 3 to 12, or 4 to 8 carbon atoms. Examples of alkynyl groups include but are not limited to ethynyl, propynyl, and butynyl.

In one aspect, the basic ashless additive of the disclosed technology is a secondary amine comprising:

i) A minimum of two aromatic substituents attached to either of the two α-carbons immediately adjacent to the amine nitrogen;

ii) A maximum of three aromatic substituents attached to the two α-carbons, and a maximum of two aromatic substituents on a single α-carbon;

iii) Optional hydrocarbyl groups on either or both α-carbons;

iv) A maximum of one hydrogen substituent on any hydrocarbyl substituted α-carbon.

In one aspect, the basic ashless additive of the disclosed technology is a secondary amine having a first α-carbon and a second α-carbon bonded to the amine nitrogen, wherein each of said first and second α-carbons, independent of the other, comprise a substituent selected from hydrogen, an aromatic group, a hydrocarbyl group, and combinations thereof, wherein at least two aromatic groups are situated at either of or both of said first and second α-carbons not exceeding a total of two aromatic groups situated on any one of said first and second α-carbons, and wherein the sum total of aromatic groups situated on said first and second α-carbons cannot exceed three, and wherein said first and second α-carbons each taken individually cannot contain two hydrogen substituents unless an aromatic substituent is present.

In a related aspect, said first α-carbon comprises two aromatic substituents and said second α-carbon comprises one aromatic substituent and one hydrocarbyl substituent.

In a related aspect, said first α-carbon comprises two aromatic substituents and said second α-carbon comprises two hydrocarbyl substituents and no aromatic substituent.

In a related aspect, said first α-carbon comprises one aromatic substituent and one hydrocarbyl substituent and said second α-carbon comprises one aromatic substituent and one hydrocarbyl substituent.

In a related aspect, said first α-carbon comprises one aromatic substituent and one hydrocarbyl substituent and said second α-carbon comprises one aromatic substituent and no hydrocarbyl substituent.

In a related aspect, said aromatic group is independently selected from a substituted and unsubstituted phenyl, naphthyl, anthryl and phenanthryl group.

In a related aspect, said aromatic groups are selected from substituted and unsubstituted phenyl which can be independently substituted with $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

In a related aspect, said hydrocarbyl substituent(s) is selected from an alkyl group having 1 to 24, or 2 to 16, or 3 to 12, or 4 to 8 carbon atoms.

In a related aspect, said hydrocarbyl group is an alkyl group selected from methyl, ethyl, propyl, butyl, pentyl, hexyl, heptyl, octyl, and combinations thereof.

In one aspect, the basic ashless additive of the disclosed technology is a secondary amine generally represented by schematic structure (I):

(I)

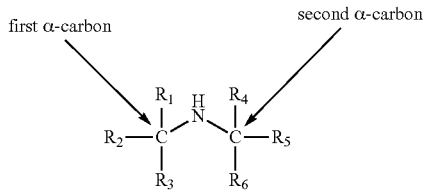

wherein $R_1$ to $R_6$ are selected from hydrogen, a $C_6$-$C_{14}$ aromatic group, a $C_1$-$C_{24}$ hydrocarbyl, or $C_2$ to $C_{16}$ hydrocarbyl, or $C_3$ to $C_{12}$ hydrocarbyl, or $C_4$ to $C_8$ hydrocarbyl, and combinations thereof, wherein at least two of $R_1$ to $R_6$ represents an aromatic group, and no more than two of $R_1$ to $R_3$ or $R_4$ to $R_6$ can be aromatic at the same time and the sum total of aromatic groups represented by $R_1$ to $R_6$ cannot exceed three, any two of $R_1$ to $R_3$ cannot be hydrogen at the same time unless one of $R_1$ to $R_3$ is an aromatic group or any two of $R_4$ to $R_6$ cannot be hydrogen at the same time unless one of $R_4$ to $R_6$ is an aromatic group.

In a related aspect, $R_1$ and $R_2$ are aromatic, $R_3$ is hydrogen, $R_4$ is aromatic, $R_5$ is hydrogen and $R_6$ is a $C_1$-$C_{24}$ hydrocarbyl group.

In a related aspect, $R_1$ and $R_2$ are aromatic, $R_3$ is hydrogen, $R_4$ and $R_5$ are independently selected from $C_1$-$C_{24}$ hydrocarbyl and $R_6$ is hydrogen.

In a related aspect, $R_1$ is aromatic, $R_2$ is hydrogen, $R_3$ is selected from $C_1$-$C_{24}$ hydrocarbyl, $R_4$ is hydrogen and $R_5$ and $R_6$ are independently selected from $C_1$-$C_{24}$ hydrocarbyl.

In a related aspect, $R_1$ is aromatic, $R_2$ is hydrogen, $R_3$ is selected from $C_1$-$C_{24}$ hydrocarbyl, $R_4$ is aromatic, $R_5$ is hydrogen, and $R_6$ is selected from $C_1$-$C_{24}$ hydrocarbyl.

In a related aspect, $R_1$ is aromatic, $R_2$ is hydrogen, $R_3$ is selected from $C_1$-$C_{24}$ hydrocarbyl, $R_4$ is aromatic, $R_5$ and $R_6$ are hydrogen.

In a related aspect, said aromatic group is independently selected from a substituted and unsubstituted phenyl, naphthyl, anthryl and phenanthryl group.

In a related aspect, said aromatic groups are selected from substituted and unsubstituted phenyl which can be independently substituted with $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

In a related aspect, said hydrocarbyl substituent(s) is selected from an alkyl group having 1 to 24, or 2 to 16, or 3 to 12, or 4 to 8 carbon atoms.

In a related aspect, said hydrocarbyl group is an alkyl group selected from methyl, ethyl, propyl, butyl, pentyl, hexyl, heptyl, octyl, and combinations thereof.

In one aspect, the basic ashless additive of the disclosed technology is a secondary amine represented by schematic structure (II):

(II)

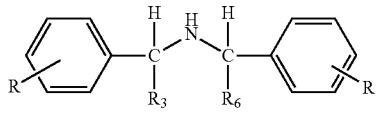

wherein $R_3$ and $R_6$ are independently selected from hydrogen and methyl and R is independently selected from hydrogen, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

In one aspect, the basic ashless additive of the disclosed technology is a secondary amine represented by schematic structure (III):

(III)

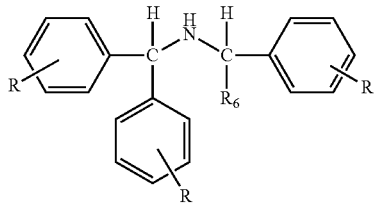

wherein $R_6$ is selected from hydrogen and methyl, and R is independently selected from hydrogen, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

In one aspect, the basic ashless additive of the disclosed technology is a secondary amine represented by schematic structure (IV):

(IV)

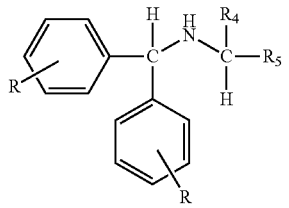

wherein $R_4$ and $R_5$ are independently selected from methyl, ethyl, propyl, butyl, pentyl, hexyl, heptyl, octyl, and R is independently selected from hydrogen, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

The basic ashless additives of the disclosed technology may be synthesized by conventional synthesis routes well-known to those skilled in the art, such as, for example, by reductive amination of a carbonyl group containing compound such as an aldehyde or ketone, or by the alkylation of a primary amine to give the desired secondary amine product. In the preparation of the basic ashless additives of the disclosed technology reductive amination entails reacting a primary amine with a carbonyl containing compound in the presence of a reducing agent such as sodium triacetoxyborohydride (STAB).

Alternatively, the desired secondary amine product may be obtained through the alkylation of a primary amine with an alkyl halide or an aromatically substituted alkyl halide.

In one aspect, the amount (treat rate) of the basic ashless secondary amine additive of the disclosed technology as a component of the oil of lubricating viscosity ranges from about 0.1 to about 6 wt. %, or from about 0.2 to about 4 wt. %, or from about 0.25 to about 2 wt. %, or from about 0.3 to about 1 wt. %, based on the weight of the total lubricating composition. The material can also be employed in a concentrate form, alone or with other additives and a lesser amount of oil. In a concentrate, the amount of material may be two to ten times the above concentration amounts. The concentrate can be used as a post-treatment additive to maintain TBN between scheduled drain intervals.

In a lubricant, the amount of the basic ashless secondary amine additive may be suitable to provide at least 0.3, or 0.5, or 0.7, or 1.0, or 1.2, or 1.5 TBN to the lubricant, and in some aspects, up to 3, or 4, or 5 TBN as measured by ASTM D4739. In one aspect, the basic ashless secondary amine delivers from about 0.5 to about 8, or from about 0.7 to about 7, or from about 0.7 to about 5, or from about 0.8 to about 4, or from about 0.8 to about 2.5, or from about 0.8 to about 1.5 mg KOH/g of ashless TBN as measured by ASTM D4739. The increase in TBN is determined relative to an identical composition in the absence of the basic ashless secondary amine additive.

The term TBN as used herein denotes the total base number in mg of KOH/gram of sample as measured by ASTM D2896 or ASTM D4739.

In certain aspects, a lubricant employing the present technology may have an entire TBN, from all sources, of at least 5 or at least 6, 7, 8, 9, or 10, and may have a TBN of up to (or less than) 25, 20, or 15. In certain aspects, a lubricant employing the present technology may have a sulfated ash content of less than 1.5 or less than 1.3 or 1.0 or 0.8 percent (as measured by ASTM D874) or may be at least 0.05 or 0.1 percent.

In addition to the disclosed basic ashless secondary amine materials, the lubricating oil composition can optionally comprise other performance additives as well. The other performance additives can comprise at least one of detergents, metal deactivators, dispersants, viscosity modifiers, friction modifiers, anti-wear agents, corrosion inhibitors, dispersant viscosity modifiers, extreme pressure agents, anti-scuffing agents, antioxidants, foam inhibitors, demulsifiers, pour point depressants, seal swelling agents, color stabilizers and mixtures thereof. Typically, a fully formulated lubricating oil will contain one or more of these performance additives. The performance additives are not necessarily limited to the additives discussed below.

Detergents

Detergents are typically overbased materials, otherwise referred to as overbased or superbased salts, which are generally homogeneous Newtonian systems having a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base or a quaternary ammonium base, and a promoter such as a phenol or alcohol. The acidic organic material will normally have a sufficient number of carbon atoms, to provide oil-solubility.

Overbased detergents can be characterized their TBN, the amount of strong acid needed to neutralize all the material's basicity, which may be expressed as mg KOH per gram of sample. Since overbased detergents are commonly provided in a form which contains diluent oil, for the purpose of this document, TBN is to be recalculated (when referring to a detergent or specific additive) to an oil-free basis. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one aspect, the metals are sodium, magnesium, or calcium. The anionic portion of the salt can be hydroxide, oxide, carbonate, borate, or nitrate. The lubricant compositions of the present technology can contain one or more of the following overbased detergents.

In one aspect, the lubricant can contain an overbased sulfonate detergent. Suitable sulfonic acids include sulfonic and thiosulfonic acids, including mono or polynuclear aromatic or cyclo-aliphatic compounds. Certain oil-soluble sulfonates can be represented by $R^{10}$-$T(SO_3^-)_a$ or $R^{11}(SO_3^-)_b$, where a and b are each at least one; T is a cyclic nucleus such as benzene or toluene; $R^{10}$ is an aliphatic group such as alkyl, alkenyl, alkoxy, or alkoxyalkyl; $(R^{10})$-T typically contains a total of at least 15 carbon atoms; and $R^3$ is an aliphatic hydrocarbyl group typically containing at least 15 carbon atoms. The groups T, $R^{10}$, and $R^{11}$ can also contain other inorganic or organic substituents. In one aspect, the sulfonate detergent may be a predominantly linear alkylbenzenesulfonate detergent having a metal ratio of at least 8 as described in paragraphs to of U.S. Pat. No. 7,407,919. In some aspects, the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^{15})_a$—Ar—$(OH)_b$, wherein $R^{15}$ is an aliphatic hydrocarbyl group of 4 to 400, or 6 to 80, or 6 to 30, or 8 to 25, or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^{15}$ groups for each phenol compound. Phenate detergents are also sometimes provided as sulfur-bridged species.

In one aspect, the overbased material is an overbased saligenin detergent. Overbased saligenin detergents are commonly overbased magnesium salts which are based on saligenin derivatives. A general example of such a saligenin derivative can be represented by formula (V):

(V)

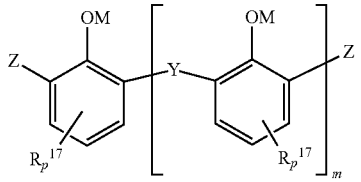

wherein Z is —CHO or —$CH_2OH$, Y is —$CH_2$— or —$CH_2OCH_2$—, and the —CHO groups typically comprise at least 10 mole percent of the Z and Y groups; M is hydrogen, ammonium, or a valence of a metal ion (that is, if M is multivalent, one of the valences is satisfied by the illustrated structure and other valences are satisfied by other species such as anions or by another instance of the same structure), $R^{17}$ is a hydrocarbyl group of 1 to 60 carbon atoms, m is 0 to typically 10, and each p is independently 0, 1, 2, or 3, provided that at least one aromatic ring contains an $R^{17}$ substituent and that the total number of carbon atoms in all $R^{17}$ groups is at least 7. When m is 1 or greater, one of the Z groups can be hydrogen. In one aspect, M is a valence of a Mg ion or a mixture of Mg and hydrogen. Saligenin detergents are disclosed in greater detail in U.S. Pat. No. 6,310,009, with special reference to their methods of synthesis (column 8 and Example 1) and preferred amounts of the various species of Z and Y (column 6).

Salixarate detergents are overbased materials that can be represented by a compound comprising at least one unit represented by formula (VI) or formula (VII):

(VI)

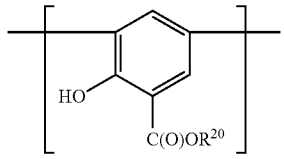

-continued (VII)

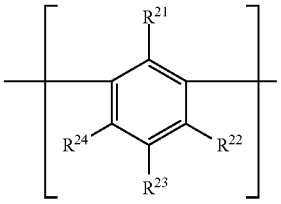

wherein each end of the compound represented by formula (VI) and formula (VII) has a terminal group represented by formula (VIII) and formula (IX):

(VIII)

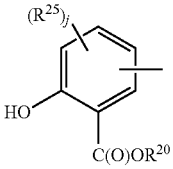

(IX)

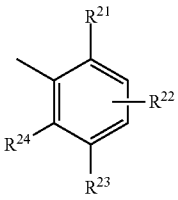

wherein such groups being linked by divalent bridging groups A, which may be the same or different. In formulae (VI) to (IX) $R^{20}$ is hydrogen, a hydrocarbyl group, or a valence of a metal ion or an ammonium ion; $R^{25}$ is hydroxyl or a hydrocarbyl group, and j is 0, 1, or 2; $R^{23}$ is hydrogen, a hydrocarbyl group, or a hetero-substituted hydrocarbyl group; either $R^{21}$ is hydroxyl and $R^{22}$ and $R^{24}$ are independently either hydrogen, a hydrocarbyl group, or hetero-substituted hydrocarbyl group, or else $R^{22}$ and $R^{24}$ are both hydroxyl and $R^{21}$ is hydrogen, a hydrocarbyl group, or a hetero-substituted hydrocarbyl group; provided that at least one of $R^{21}$, $R_{22}$, $R_{23}$ and $R^{24}$ is hydrocarbyl containing at least 8 carbon atoms; and wherein the molecules on average contain at least one of unit (VI) or (VIII) and at least one of unit (VII) or (IX) and the ratio of the total number of units (VI) and (VIII) to the total number of units of (VII) and (IX) in the composition is 0.1:1 to 2:1. The divalent bridging group "A", which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate".

Glyoxylate detergents are similar overbased materials which are based on an anionic group which, in one aspect, can have a structure represented by the formula (X):

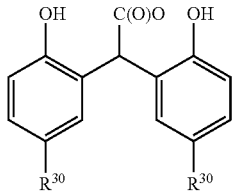

(X)

wherein $R^{30}$ is independently an alkyl group containing at least 4 or 8 carbon atoms, provided that the total number of carbon atoms in all $R^{30}$ substitutents is at least 12 or 16 or 24. Alternatively, each $R^{30}$ substituent can be an olefin polymer substituent. The acidic material upon from which the overbased glyoxylate detergent is prepared may be a condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate, e.g., an alkali metal or alkaline earth metal or ammonium salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one aspect, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain aspects, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some aspects, such hydrocarbyl substituents contain at least 14 or at least 18 carbon atoms.

The amount of the overbased detergent, in the formulations of the present technology, is typically at least 0.6 weight percent on an oil-free basis, or 0.7 to 5 weight percent, or 1 to 3 weight percent. Either a single detergent or multiple detergents can be present.

The amount of overbased detergent can also be represented by the amount of metal, specifically alkaline earth metal, delivered to the lubricating composition by the detergent. In one aspect, the overbased detergent is present in an amount to deliver 500 ppm to 3000 ppm, or 800 to 2400 ppm by weight alkaline earth metal to the composition, or combinations of alkaline earth metals. The overbased detergent may be present in an amount to deliver 1000 ppm to 2500 ppm calcium to the composition, or in an amount to deliver 400 ppm to 2500 ppm magnesium to the composition, or combinations thereof. In one embodiment, the lubricating composition comprises at least 400 ppm magnesium and no more than 1500 ppm calcium from overbased detergents.

The amount of overbased detergent can also be represented by the amount of sulfated ash delivered to the lubricating composition by the detergent. In one aspect, the one or more overbased detergents are present in an amount to deliver 0.05 weight percent to 1.2 weight percent, or 0.25 to 0.85 weight percent, or 0.15 to 0.5 weight percent sulfated ash to the lubricating composition. In one aspect, the overbased detergent is present in an amount to deliver less than 1 weight percent, or less than 0.75 weight percent, or less than 0.45 weight percent sulfated ash to the lubricant composition.

Dispersants

Dispersants are well-known in the field of lubricants and include primarily what is known as ashless dispersants and polymeric dispersants. Ashless dispersants are so-called because, as supplied, they do not contain metal and thus do not normally contribute to sulfated ash when added to a lubricant. However, they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long-chain alkenyl succinimides, having a variety of chemical structures including those conforming to formula (XI):

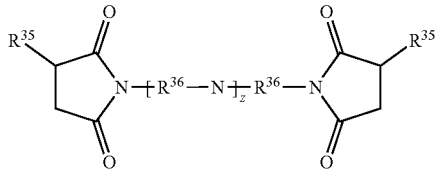

(XI)

wherein in one aspect, each $R^{35}$ is independently an alkyl group, and in another aspect, a polyisobutylene group with a molecular weight ($M_n$) of 500-5000 based on the polyisobutylene precursor, and $R^{36}$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^{35}$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have general structure (XII):

(XII)

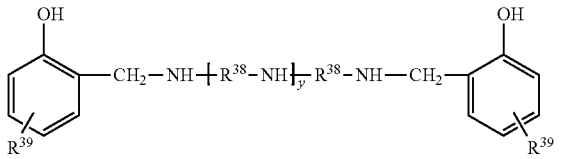

wherein $R^{38}$ is an alkylene group, e.g., an ethylene group (—$CH_2CH_2$—); and $R^{39}$ is a hydrocarbyl substituent having from about 40 to about 20,000 carbon atoms, or from about 80 to about 250 carbon atoms. In one aspect, $R^{39}$ is selected from polyisobutyl and polypropyl substitutents derived from the alkylation of the phenol moiety with polybutylenes or polypropylenes. The foregoing Mannich base dispersants described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are disclosed in U.S. Pat. No. 4,654,403.

The amount of the dispersant in a fully formulated lubricant of the present technology may be at least 0.1% of the lubricant composition, or at least 0.3 wt. %, or 0.5 wt. %, or 1 wt. %, and in certain aspects, at most 9 wt. %, or 8 wt. %, or 6 wt. %, or 4 wt. %, or 3 wt. %, or 2 wt. %, based on the weight of the total composition.

Viscosity Modifiers

Another performance additive component that can be employed in the lubricant of the disclosed technology is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20 wt. % by weight. Concentrations of 1 to 12 wt. %, or 3 to 10 wt. %, based on the weight of the total lubricant composition may be employed.

Antioxidants

Another performance additive component that can be employed in the lubricant of the disclosed technology is an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain aspects, the para position is occupied by an ester-containing group, such as, for example, an antioxidant of the formula (XIII):

(XIII)

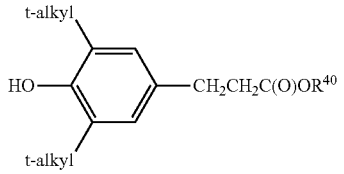

wherein $R^{40}$ is a hydrocarbyl group such as an alkyl group containing, e.g., 1 to 18, or 2 to 12, or 2 to 8, or 2 to 6 carbon atoms; and t-alkyl can be a t-butyl moiety. Such antioxidants are described in greater detail in U.S. Pat. No. 6,559,105.

Antioxidants also include aromatic amines. In one aspect, an aromatic amine antioxidant can comprise an alkylated diphenylamine such as nonylated diphenylamine or a mixture of a di-nonylated and a mono-nonylated diphenylamine, or an alkylated phenylnaphthylamine, or mixtures thereof.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present technology include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Other materials that may serve as antioxidants include titanium compounds. U.S. Pat. No. 7,727,943 discloses a variety of titanium compounds, including titanium alkoxides and titanated dispersants, which materials may also impart improvements in deposit control and filterability. Other titanium compounds include titanium carboxylates such as neodecanoate.

Typical amounts of antioxidants will, of course, depend on the specific antioxidant and its individual effectiveness, but illustrative total amounts can range from about 0.01 to about 5 wt. %, or from about 0.15 to about 4.5 wt. %, or from about 0.2 to about 4 wt. %, based on the weight of the total composition.

Anti-Wear Agents

The lubricant compositions of the disclosed technology can also contain anti-wear agent. In one aspect the anti-wear agent is a metal salt of a phosphorus acid of the formula (XIV):

$$[(R^{43}O)(R^{44}O)P(=S)(-S)]_n\text{-}M \quad \text{(XIV)}$$

wherein $R^{43}$ and $R^{44}$ are, independently, hydrocarbyl groups containing 3 to 30 carbon atoms, and can be obtained by heating phosphorus pentasulfide ($P_2S_5$) and an alcohol or phenol to form an O,O-dihydrocarbyl phosphorodithioic acid. The alcohol which reacts to provide the $R^{43}$ and $R^{44}$ groups may be a mixture of alcohols, for instance, a mixture of isopropanol and 4-methyl-2-pentanol, and in some aspects, a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates (ZDP). Such materials are well-known and readily available to those skilled in the art of lubricant formulation. Suitable variations to provide good phosphorus retention in an engine are disclosed, for instance, in U.S. Pat. No. 7,772,171.

Examples of materials that may serve as anti-wear agents include phosphorus-containing antiwear/extreme pressure agents such as metal thiophosphates as described above, phosphoric acid esters and salts thereof, phosphorus-containing carboxylic acids, esters, ethers, and amides; and phosphites. In certain aspects, a phosphorus antiwear agent may be present in an amount to deliver from about 0.01 to about 0.2, or from about 0.015 to about 0.15, or from about 0.02 to about 0.1, or from about 0.025 to about 0.08 percent phosphorus. Often the antiwear agent is a zinc dialkyldithiophosphate (ZDP). For a typical ZDP, which may contain 11 percent P (calculated on an oil free basis), suitable amounts may include from about 0.09 to about 0.82 percent. Non-phosphorus-containing anti-wear agents include borate esters (including borated epoxides), dithiocarbamate compounds, molybdenum-containing compounds, and sulfurized olefins.

Other materials that may be used as anti-wear agents include tartrate esters, tartramides, and tartrimides. Examples include oleyl tartrimide (the imide formed from oleylamine and tartaric acid) and oleyl diesters (from, e.g., mixed $C_{12}$-$C_{16}$ alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in U.S. Pat. No. 7,651,987 and PCT Publication WO WO2010/077630. Such derivatives of (or compounds derived from) a hydroxy-carboxylic acid, if present, may typically be present in the lubricating composition in an amount of from about 0.1 weight % to about 5 wt. %, or from about 0.2 to about 3 wt. %, based on the weight of the total composition.

The amount of each chemical component described herein is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade product.

These additional performance additives may be present in the overall lubricant composition from about 0 or about 0.1 to about 30 wt. %, or from about 1 to about 20 wt. %, or from about 3 to about 20 wt. %, or from about 5 to about 18 wt. %, or from about 8 to about 15 wt. %, or from about 10 to about 12 wt. %, based on the weight of the total composition. The oil of lubricating viscosity will in some aspects make up the balance of the composition, and/or may be present from about 66 to about 99.9 wt. %, or about 99.8 wt. %, or from about 78 to about 98.9 wt. %, or from about 78.5 to about 94.5 wt. %, or from about 78.9 to about 89.1 wt. %, or from about 83.9 to about 89.1 wt. %, or about 85 wt. %, based on the weight of the total composition.

In different aspects, the lubricating composition can have a composition as described in the following table.

| | Aspects (wt %) | | |
|---|---|---|---|
| Additive | A | B | C |
| Corrosion Additive | 0.01 to 4 | 0.2 to 2 | 0.35 to 1.5 |
| Antiwear Agents | 0.15 to 6 | 0.2 to 4 | 0.5 to 2 |
| Ashless Antioxidants | 1.2 to 7 | 1.2 to 5 | 2 to 5 |
| Metal Detergents | 0.2 to 8 | 0.2 to 4 | 0.5 to 2 |
| Polyolefin Dispersants | 0.8 to 8 | 1 to 6 | 1.5 to 4 |
| Viscosity Modifier | 0 or 0.1 to 4.5 | 0.5 to 4 | 0.8 to 2.5 |
| Dispersant Viscosity Modifier | 0 or 0.1 to 4.5 | 0 or 0.1 to 2.5 | 0.5 to 1.6 |
| Friction Modifier | 0 or 0.05 to 4 | 0.05 to 3 | 0.1 to 2 |
| Any Other Performance Additive | 0 or 0.05 to 10 | 0 or 0.05 to 8 | 0 or 0.05 to 6 |
| Oil of Lubricating Viscosity | Balance to 100 % | | |

The lubricating composition of the disclosed technology may be utilized in an internal combustion engine. The engine components may have a surface of steel or aluminum (typically a surface of steel) and may also be coated for example with a diamond-like carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may be fitted with an emission control system or a turbocharger. Examples of the emission control system include diesel particulate filters (DPF), or systems employing selective catalytic reduction (SCR). The internal combustion engine may or may not have an Exhaust Gas Recirculation system.

In one aspect, the internal combustion engine may be a diesel fueled engine (typically a heavy-duty diesel engine), a gasoline fueled engine, a natural gas fueled engine, or a mixed gasoline/alcohol fueled engine. The engine may be a spark ignited engine and or a compression ignited engine. The internal combustion engine may be a 2-stroke or 4-stroke engine. Suitable internal combustion engines include marine diesel engines, aviation piston engines, low-load diesel engines, and gasoline fueled automobile and truck engines.

The internal combustion engine described herein is distinct from a gas turbine. In an internal combustion engine, individual combustion events translate from a linear reciprocating force into a rotational torque through the rod and crankshaft. In contrast, in a gas turbine (which may also be referred to as a jet engine) a continuous combustion process generates a rotational torque continuously without translation and can also develop thrust at the exhaust outlet. These differences in operation conditions of a gas turbine and internal combustion engine result in different operating environments and stresses.

The lubricant composition for an internal combustion engine may be suitable for any engine lubricant irrespective of the sulfur, phosphorus or sulfated ash (ASTM D-874) content. In one aspect, the sulfur content of the engine oil of lubricating viscosity can be 1 wt. % or less, or 0.8 wt. % or less, or 0.5 wt. % or less, or 0.3 wt. % or less, based on the total weight of the engine oil composition. In one aspect, the sulfur content can be in the range of 0.001 wt. % to 0.5 wt. %, or 0.01 wt. % to 0.3 wt. %, based on the total weight of the engine oil composition. In one aspect, the phosphorus content is 0 wt. %, or 0.2 wt. % or less, or 0.12 wt. % or less, or 0.1 wt. % or less, or 0.085 wt. % or less, or 0.08 wt. % or less, or 0.06 wt. % or less, 0.055 wt. % or less, or 0.05 wt. % or less, based on the total weight of the engine oil composition. In one aspect, the phosphorus content is 0 ppm, or can range from 100 ppm to 1000 ppm, or 200 ppm to 600 ppm, based on the total weight of the engine oil composition. In one aspect, the total sulfated ash content can be 2 wt. % or less, or 1.5 wt. % or less, or 1.1 wt. % or less, or 1 wt. % or less, or 0.8 wt. % or less, or 0.5 wt. % or less, or 0.4 wt. % or less, based on the total weight of the engine oil composition. In one aspect, the sulfated ash content may be 0.05 to 0.9 wt. %, or 0.1 wt. % to 0.2 wt. % or up to 0.45 wt. %, based on the total weight of the engine oil composition.

In one aspect, the lubricating composition is characterized as having at least one of (i) a sulfur content of about 0.5 wt. % or less, or 0.4 wt. % or less, (ii) a phosphorus content of about 0.1 wt. % or less, and (iii) a sulfated ash content of about 1.5 wt. % or less, or combinations thereof. In one aspect, the lubricating composition comprises less than about 1.5 wt. % unreacted polyisobutene, or less than about 1.25 wt. %, or less than about 1.0 wt. %.

In some aspects, the lubricant composition is an engine oil composition for a turbocharged direct injection (TDI) engine.

The disclosed technology also provides a method of reducing deposits and mitigating seals degradation in an internal combustion engine comprising:

(1) supplying to the engine a lubricant composition comprising:
   a) an oil of lubricating viscosity; and
   b) a basic ashless additive selected form a secondary amine of the formula:

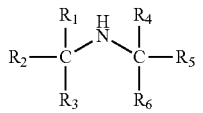

wherein $R_1$ to $R_6$ are selected from hydrogen, a $C_6$-$C_{14}$ aromatic group, a $C_1$-$C_{24}$ hydrocarbyl, or $C_2$ to $C_{16}$ hydrocarbyl, or $C_3$ to $C_{12}$ hydrocarbyl, or $C_4$ to $C_8$ hydrocarbyl, and combinations thereof, wherein at least two of $R_1$ to $R_6$ represents an aromatic group, and no more than two of $R_1$ to $R_3$ and $R_4$ to $R_6$ can be aromatic at the same time and the sum total of aromatic groups represented by $R_1$ to $R_6$ cannot exceed three, any two of $R_1$ to $R_3$ cannot be hydrogen at the same time unless one of $R_1$ to $R_3$ is an aromatic group or any two of $R_4$ to $R_6$ cannot be hydrogen at the same time unless one of $R_4$ to $R_6$ is an aromatic group; and (2) operating the engine. In some aspects, the engine is a turbocharged direct injection (TDI) engine.

The following examples provide illustrations of the disclosed technology. Unless otherwise specified the amounts of components set forth in the Examples below are given in weight percent based on the weight of the total composition. These examples are non-exhaustive and are not intended to limit the scope of the present technology.

EXAMPLES

Example A

To a 3 L flask equipped with a stirrer, thermocouple, nitrogen inlet and water-cooled condenser was added tetrahydrofuran (1500 ml) and benzhydrylamine (172.8 g). To this was added 2-butanone (68 g) and the mixture was stirred for approximately 1 hour at ambient room temperature. To this mixture was added STAB, sodium trisacetoxyborohydride (250 g) over approximately 1.5 hours and the reaction mixture was stirred for approximately 4 days at ambient room temperature. At this point, the reaction mixture was quenched with 2M NaOH (aqueous) (551 ml), over 1.5 hours controlling the exotherm. To the reaction was added tert-butylmethyl ether (1268 ml) and the organic layer was separated. The organics were dried, filtered and the product isolated by vacuum stripping. The product was additionally purified by addition to a beaker of 2M NaOH (aqueous) with stirring for 1 hour. At this point the mixture was extracted with dichloromethane (500 ml). The organics were separated and washed with water (500 ml), dried with $MgSO_4$ and filtered. The solution was then stripped under reduced pressure to yield N-benzhydrylbutan-2-amine (176.2 g) represented by the structure:

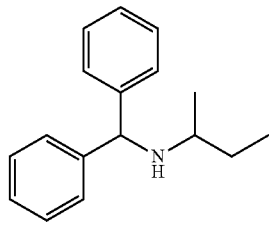

Example B

Benzaldehyde was aminated with α-methylbenzylamine in accordance with the procedure of Example A to afford N-benzyl-1-phenylethan-1-amine represented by the structure:

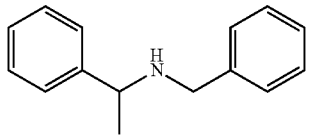

Example C (Comparative)

2-ethylhexanal was aminated with α-methylbenzylamine in accordance with the procedure of Example A to afford 2-ethyl-N-(1-(4-methoxyphenyl)ethyl)hexan-1-amine represented by the structure:

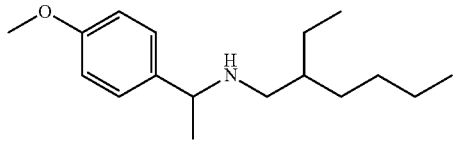

Example D (Comparative)

2-ethylhexanal was aminated with 1-cyclohexylethylamine in accordance with the procedure of Example A to afford N-(1-cyclohexylethyl)-2-ethylhexan-1-amine represented by the structure:

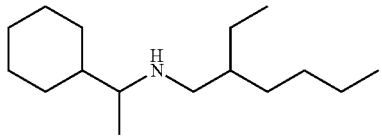

Example E

To a 5 L flask equipped with a stirrer, PTFE thermocouple, nitrogen inlet and water-cooled condenser was added xylene (2000 ml) followed by benzhydrylamine (238.9 g). To this was added sodium carbonate (207.3 g) followed by 1-bromoethylbenzene (241.3 g). The reaction mixture was stirred and heated to 140° C. for 20 hours. At this point, the reaction mixture was cooled and filtered. The filtrate was stripped under reduced pressure to leave an orange oil (130.6 g). The product was further purified using silica column chromatography, eluting with 10% Ethyl acetate/hexane. After removal of solvent this yielded N-benzhydryl-1-phenylethan-1-amine as a pale-yellow liquid (170.4 g) having the structure:

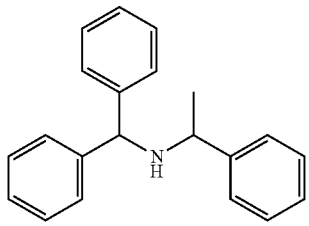

Example F

Alpha-methylbenzylamine was alkylated with 1-bromoethylbenzene in accordance with the procedure of Example E to yield bis(1-phenylethyl)amine) having the structure:

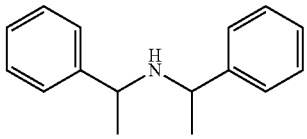

Example G 1-(4-methoxy-phenyl)ethylamine was alkylated with 1-bromoethylbenzene in accordance with the procedure of Example E to yield 1-(4-methoxyphenyl)-N-(1-phenylethyl) ethan-1-amine of the structure:

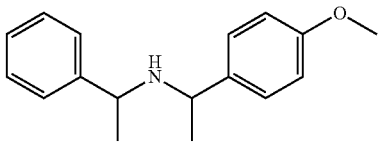

Example H (Comparative)

2-ethylhexylamine was alkylated with 1-bromoethylbenzene in accordance with the procedure of Example E to give 2-ethyl-N-(1-phenylethyl)hexan-1-amine of the structure:

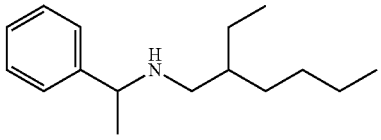

Example I (Comparative)

Cyclohexylamine was alkylated with 1-bromoethylbenzene in accordance with the procedure of Example E to yield 1-cyclohexyl-N-(1-phenylethyl)ethan-1-amine of the structure:

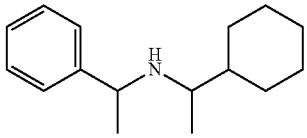

Lubricating Compositions and Test Data

A series of 15W-40 engine lubricants in Group II base oils of lubricating viscosity were prepared containing the basic amine additives described above as well as conventional additives including polyisobutenyl succinimide dispersants, polymeric viscosity modifier, overbased detergents, antioxidants (combination of phenolic ester and diarylamine), zinc dialkyldithiophosphate (ZDDP), as well as other conventional performance additives as follows (Table 1). The calcium, magnesium, phosphorus, zinc and ash contents of each of the examples are also presented in the table in part to show that each example has a similar amount of these materials and so provide a proper comparison between the comparative and illustrative examples of the present technology.

TABLE 1

(Lubricating Compositions)

| | EX1 | EX2 | EX3 | EX4 | EX5 | EX6 | EX7 | EX8 | EX9 |
|---|---|---|---|---|---|---|---|---|---|
| Group II Base Oil | Balance to 100% | | | | | | | | |
| Example A | | 0.43 | | | | | | | |
| Example B | | | 0.38 | | | | | | |
| Example D | | | | 0.45 | | | | | |
| Example E | | | | | 0.52 | | | | |
| Example F | | | | | | 0.41 | | | |
| Example G | | | | | | | 0.46 | | |
| Example H | | | | | | | | 0.42 | |
| Example I | | | | | | | | | 0.43 |
| Boron-Free PIB Succinimide[2] | 3.4 | 3.4 | 3.4 | 3.4 | 3.4 | 3.4 | 3.4 | 3.4 | 3.4 |
| Borated PIB Succinimide[3] | 1.0 | 1.0 | 1.0 | 1.0 | 1.0 | 1.0 | 1.0 | 1.0 | 1.0 |
| Overbased Calcium Sulfonate[4] | 1.06 | 1.06 | 1.06 | 1.06 | 1.06 | 1.06 | 1.06 | 1.06 | 1.06 |
| Calcium Sulfurized-Phenate[5] | 0.25 | 0.25 | 0.25 | 0.25 | 0.25 | 0.25 | 0.25 | 0.25 | 0.25 |
| Calcium Salixarate | 0.4 | 0.4 | 0.4 | 0.4 | 0.4 | 0.4 | 0.4 | 0.4 | 0.4 |
| $C_3/C_6$ Secondary ZDDP | 1.0 | 1.0 | 1.0 | 1.0 | 1.0 | 1.0 | 1.0 | 1.0 | 1.0 |
| Ashless Antioxidant[6] | 2.55 | 2.55 | 2.55 | 2.55 | 2.55 | 2.55 | 2.55 | 2.55 | 2.55 |
| Soot Dispersant[7] | 0.5 | 0.5 | 0.5 | 0.5 | 0.5 | 0.5 | 0.5 | 0.5 | 0.5 |
| Ethylene-Propylene Copolymer | 0.48 | 0.48 | 0.48 | 0.48 | 0.48 | 0.48 | 0.48 | 0.48 | 0.48 |
| Other Additives[8] | 0.66 | 0.66 | 0.66 | 0.66 | 0.66 | 0.66 | 0.66 | 0.66 | 0.66 |
| TBN (D4739) | 6.4 | 7.3 | 7.3 | 7.3 | 7.2 | 7.2 | 7.2 | 7.3 | 7.3 |
| TBN (D2896) | 9.1 | 10.1 | 10.0 | 10.0 | 9.9 | 9.9 | 10.0 | 10.1 | 10.1 |
| Calcium (ppm) | 2280 | 2210 | 2140 | 2140 | 2130 | 2035 | 2140 | 2240 | 2160 |
| Phosphorus (ppm) | 1190 | 1135 | 1120 | 1120 | 1140 | 1080 | 1115 | 1090 | 1130 |
| Zinc (PPM) | 1350 | 1280 | 1270 | 1270 | 1320 | 1250 | 1260 | 1215 | 1290 |

[1]All treat rates are oil free, unless otherwise indicated

[2]Combination of conventional (chlorine process) and thermal "ene" polyisobutenyl succinimide dispersants, prepared with a mixture of aliphatic and aromatic polyamines.

[3]Boron-containing polyisobutenyl succinimide dispersant.

[4]Combination of overbased calcium alkylbenzene sulfonate detergents (TBN of 170 and 500 mg KOH/g).

[5]Overbased calcium sulfur-coupled phenate detergent (TBN 400 mg KOH/g).

[6]Combination of sulfurized olefins, alkylated diarylamine compounds and hindered phenol ester compounds.

[7]Ethylene-propylene copolymers functionalized with a mixture of aromatic amines and aromatic polyamines.

[8]Other additives include pourpoint depressant, corrosion inhibitor, and anti-foam agent.

The engine lubricating compositions formulated in Table 1 are evaluated in bench and engine tests designed to assess the ability of the lubricant to prevent corrosion and mitigate seals degradation. The lubricating compositions are further tested to evaluate the ability to prevent or reduce deposit formation, provide cleanliness, improve oxidation stability and reduce or prevent acid-mediated wear or degradation of the lubricant. The lubricant samples are subjected to industry standard deposit and oxidation tests such as Komatsu Hot Tube (KHT), Pressure Differential Scanning calorimetry (PDSC) (e.g. L85-99), MHT TEOST (ASTM D7097), and TEOST 33C (ASTM D6335). The lubricant compositions are subjected to industry standard seals and corrosion bench tests.

The lubricant samples were subjected to a 168 hour, 150° C. fluorocarbon seal compatibility test. Seal materials ("MB"—Mercedes Benz seals) DBL6674-FKM are evaluated before and after immersion in the lubricants under the stated conditions. The lubricants were also subjected to a corrosion test according to ASTM D6594. The compositions and results are summarized below in Table 2.

TABLE 2

(Corrosion and Seals Evaluation)

| | EX1 | EX2 | EX3 | EX4 | EX5 | EX6 | EX7 | EX8 | EX9 |
|---|---|---|---|---|---|---|---|---|---|
| Fluorelastomer Seals | | | | | | | | | |
| Rupture elongation change (%) | −51 | −57 | −60 | −77 | −52 | −57 | −60 | −69 | −69 |
| Tensile Strength change (%) | −58 | −55 | −51 | −67 | −56 | −48 | −54 | −65 | −63 |
| High Temperature Corrosion | | | | | | | | | |
| Copper (ppm) | 2.9 | 3.3 | 4.2 | 4.2 | 3.2 | 3.3 | 3.7 | 4.2 | 3.9 |
| Lead (ppm) | 1.9 | 1.5 | 1.9 | 2.5 | 1.4 | 1.5 | 1.3 | 1.9 | 1.3 |
| Copper Rating[1] | 1a[2] | 1a[2] | 1a[2] | 1a[2] | 1a[2] | 1a[2] | 1a[2] | 1a[2] | 1a[2] |

[1]Copper Strip Corrosion Test (ASTM D130).

[2]ASTM D130 Visual Rating: Class 1, Designation - Slight Tarnish, Description - Light Orange, Almost the Same as a Freshly Polished Strip (1a).

The data indicates that the lubricant compositions containing the amine additive of the present technology provide TBN by both strong (D4739) and weak (D2896) titrants while maintaining strong corrosion resistance.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the disclosed technology can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

a) an oil of lubricating viscosity; and b) a secondary amine having a first α-carbon and a second α-carbon bonded to the amine nitrogen, wherein said first α-carbon comprises two aromatic substituents and said second α-carbon comprises one aromatic substituent and one hydrocarbyl substituent wherein said hydrocarbyl substituent is selected from $C_1$ to $C_{24}$ alkyl, or wherein said first α-carbon comprises two aromatic substituents and said second α-carbon comprises two hydrocarbyl substituents and no aromatic substituent, wherein said hydrocarbyl substituent is selected from $C_1$ to $C_{24}$ alkyl, or wherein said first α-carbon comprises one aromatic substituent and one hydrocarbyl substituent, and said second α-carbon comprises one aromatic substituent and no hydrocarbyl substituent, wherein said hydrocarbyl substituent is selected from $C_1$ to $C_{24}$ alkyl, or wherein said first α-carbon comprises one aromatic substituent and one hydrocarbyl substituent and said second α-carbon comprises one aromatic substituent and one hydrocarbyl substituent, wherein said hydrocarbyl substituent is selected from $C_1$ to $C_{24}$ alkyl, and wherein at least one of said aromatic substituents is substituted with a substituent selected from $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

2. A lubricant composition of claim 1, wherein said aromatic substituent is selected from phenyl, naphthyl, anthryl, phenanthryl, and combinations thereof.

3. A lubricant composition of claim 1, wherein said aromatic substituent group is independently substituted with $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

4. A lubricant composition of claim 1, wherein said hydrocarbyl substituent is selected from methyl, ethyl, propyl, butyl, pentyl, hexyl, heptyl, octyl, and combinations thereof.

5. A lubricant composition of claim 1, wherein said aromatic group is substituted and unsubstituted phenyl and said hydrocarbyl group is methyl.

6. A lubricant composition of claim 1, wherein component b) is selected from a compound of the formula:

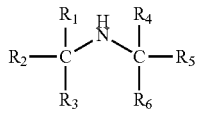

wherein $R_1$ and $R_2$ are aromatic, $R_3$ is hydrogen, $R_4$ is aromatic, $R_5$ is hydrogen and $R_6$ is a $C_1$-$C_{24}$ alkyl group, or wherein $R_1$ and $R_2$ are aromatic, $R_3$ is hydrogen, $R_4$ and $R_5$ are independently selected from $C_1$-$C_{24}$ alkyl and $R_6$ is hydrogen, or wherein $R_1$ is aromatic, $R_2$ is hydrogen, $R_3$ is selected from $C_1$-$C_{24}$ alkyl, $R_4$ is aromatic, $R_5$ and $R_6$ are hydrogen.

7. A lubricant composition of claim 6, wherein said aromatic group is selected from selected from phenyl, naphthyl, anthryl, phenanthryl, and combinations thereof.

8. A lubricant composition of claim 6, wherein said hydrocarbyl group is selected from methyl, ethyl, propyl, butyl, pentyl, hexyl, heptyl, octyl, and combinations thereof.

9. A lubricant composition of claim 1, wherein said aromatic group is substituted and unsubstituted phenyl and said hydrocarbyl group is methyl.

10. A lubricant composition of claim 6, wherein component b) is selected from a compound of the formula:

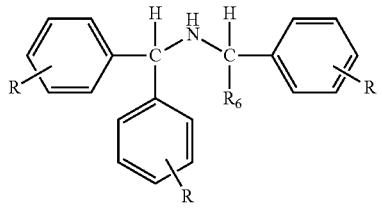

wherein $R_6$ is selected from hydrogen and methyl, and R is independently selected from hydrogen, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

11. A lubricant composition of claim 6, wherein component b) is selected from a compound of the formula:

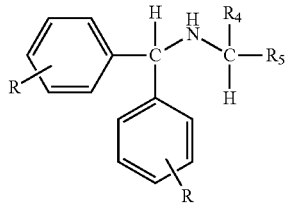

wherein $R_4$ and $R_5$ are independently selected from methyl, ethyl, propyl, butyl, pentyl, hexyl, heptyl, octyl, and R is independently selected from hydrogen, $C_1$-$C_{10}$ alkyl, $C_2$-$C_{10}$ alkenyl, amino, hydroxyl, hydroxy substituted $C_1$-$C_{10}$ alkyl, $C_1$-$C_{10}$ alkoxy, and combinations thereof.

12. A lubricant composition of claim 1, wherein component b) is selected from N-benzhydryl-1-phenyl-1-amine, N-benzhydrylbutan-2-amine, N-benzyl-1-phenylethan-1-amine, 1-(4-methoxyphenyl)-N-phenylethyl) ethan-1-amine, and mixtures thereof.

13. A lubricant composition of claim 1, wherein the oil of lubricating viscosity comprises a mineral oil, a synthetic oil, or a combination thereof.

14. A lubricant composition of claim 1, wherein said oil of lubricating viscosity is at least one of an API Group I oil, Group II oil, Group III oil, and mixtures thereof.

15. A lubricant composition of claim 1, wherein said secondary amine is capable of acid titration in accordance with ASTM D4739.

16. A lubricant composition of claim 1, wherein said secondary amine is capable of titrating greater than 100 mg of KOH/g in accordance with ASTM D4739.

17. A lubricant composition of claim 1, wherein said secondary amine is present in an amount ranging from about 0.1 to about 6 wt. %, based on the weight of the total composition.

18. A lubricant composition of claim 1, wherein said secondary amine delivers from about 0.5 to about 8 mg KOH/g of ashless TBN as measured by ASTM D4739.

19. A lubricant composition of claim 1, wherein said lubricant composition contains 1 wt. % or less.

20. A lubricant composition of claim 1, wherein said lubricant composition contains 0.2 wt. % or less phosphorous.

21. A lubricant composition of claim 1, wherein said lubricant composition contains 1.5 wt. % or less of sulfated ash.

22. The lubricant composition of claim 1, wherein the lubricant composition further comprises an additive selected from one or more ashless dispersants, viscosity modifiers, pour point depressants, antioxidants, friction modifiers, zinc dithiophosphates, detergents, antiwear agents, corrosion inhibitors, antifoam agents, or any combination thereof.

23. The lubricant composition of claim 22 further comprising a detergent selected from one or more overbased metal detergent(s).

24. The lubricant composition of claim 23, wherein said one or more overbased detergent(s) is present in an amount sufficient to deliver 0.05 wt. % to 1.2 wt. % sulfated ash to the lubricating composition.

25. The lubricant composition of claim 23, wherein said one or more overbased detergent(s) is present in an amount sufficient to deliver less than 1 wt. % sulfated ash to the lubricant composition.

26. A method of mitigating crankcase seals degradation in an internal combustion engine comprising supplying to said engine a lubricant composition of claim 1.

27. A method of lubricating an internal combustion engine comprising supplying to said engine a composition of claim 1 and operating said engine under normal operating conditions.

28. A method of neutralizing acidic combustion by-products in an internal combustion engine comprising supplying to said engine a composition of claim 1 and operating said engine under normal operating conditions.

29. A method of mitigating rust formation in an internal combustion engine comprising supplying to said engine a composition of claim 1 and operating said engine under normal operating conditions.

* * * * *